US005762062A

United States Patent [19]

Hawkinson et al.

[11] Patent Number: 5,762,062

[45] Date of Patent: Jun. 9, 1998

[54] FIREPLACE VENT

[75] Inventors: Eric Hawkinson; Michael McKim, both of Mt. Pleasant, Iowa

[73] Assignee: Hon Industries Inc., Muscatine, Iowa

[21] Appl. No.: 585,794

[22] Filed: Jan. 16, 1996

[51] Int. Cl.[6] ..... F24C 3/00

[52] U.S. Cl. ..... 126/85 B; 126/307 R; 126/500

[58] Field of Search ..... 126/85 B, 500, 126/307 R

[56] References Cited

U.S. PATENT DOCUMENTS 3,052,230 9/1962 Conrad ..... 126/85 B X 3,435,816 4/1969 DeWerth ..... 126/85 B 4,898,154 2/1990 Richison ..... 126/500

*Primary Examiner*—Larry Jones

*Attorney, Agent, or Firm*—Jones, Day, Reavis & Pogue

[57] ABSTRACT

A fireplace vent of the direct-vent type comprises two telescoping sections each having outer air intake housings and inner exhaust housings. One section has an adapter configured to communicate with a standard round concentric vent pipe of a fireplace. The other section has a termination cap. A pair of heat shields are disposed in spaced parallel relationship over the outer intake housing of each section. The vent can be installed horizontally on the fireplace to vent the fireplace through a wall with a minimum of height of an associated window or shelving unit above the fireplace. The adjustable telescoping configuration of the two vent sections also allows for ease in installation by avoiding the need to cut the vent to proper length.

16 Claims, 5 Drawing Sheets

FIREPLACE VENT

BACKGROUND OF THE INVENTION

1 . Field of the Invention

The present invention relates generally to vents for fireplaces and, more particularly, to a fireplace vent configured to vent horizontally through a building wall at a low elevation relative to the fireplace.

2 . Description of the Prior Art

Factory-built fireplace assemblies have long been available to be used as both free-standing and wall-recessed units. One popular form of fireplace functions as a room heater and comprises a combustion chamber surrounded by an enclosure providing a passageway for circulating room air over the combustion chamber. Heated air may thereby be circulated into the room either by gravity or by use of a blower system. This type of fireplace is preferably fired with natural or LP gas and has ceramic or cement artificial logs simulating the appearance of a wood burning fireplace while offering the advantage of efficiently converting the natural or LP gas to room heat.

A typical gas-fired fireplace for use in an enclosed room of a house, for example, must be vented to the outside of the house to avoid combustion products from filling the room. One commonly used system for venting fireplaces is a direct-vent system. Typically, direct-vent fireplaces use a vent system comprising a dual, concentric flue pipe arrangement in which an inner pipe serves to exhaust combustion products while a larger outer pipe defines an annular passageway for conducting fresh air into the fireplace combustion chamber. By this arrangement, incoming fresh air has the effect of cooling the inner exhaust pipe and a chimney may be built around the vent without expensive masonry construction. Thus, factory-built direct-vent fireplaces have become popular in recent times in modern building architecture.

In building construction, it is sometimes found desirable to install a fireplace on a wall beneath a window or a shelving system, with the fireplace vented horizontally through the wall. With conventional eight-inch diameter round vent pipe, it is necessary, in practice, to allow a minimum of fourteen inches in height between the top wall of the fireplace and the top of the pipe. This minimum dimension is needed to allow for the radius of a conventional 90 degree elbow. In addition, standard building codes such as those promulgated by the American National Standards Institute require additional air space clearance between the top of the vent pipe and the bottom of a window or shelf. This clearance is typically on the order of three inches or more. Accordingly, in a construction using a standard round vent pipe, a window or shelf unit may be positioned no closer than seventeen inches from the top of the fireplace. Moreover, for a fireplace having a top wall height of thirty-five inches above the room floor, the minimum height of a window or shelf above the floor would be fifty-two inches. This minimum height would be for an inoperable window. In cases in which the window is operable even additional height is necessary under standard codes to prevent combustion gases from entering the room through the window when the window is open. This height clearance required with conventional vent pipe may be undesirable both aesthetically and functionally.

Accordingly, it is desirable to provide a direct-vent system for a factory-built fireplace in which the vent is designed to minimize the height of a window or shelf system above the fireplace and, therefore, such window or shelf system is positioned at a minimum height above the room floor. It is further desirable to provide such a vent system which can be readily installed without the need for additional labor involved in cutting the vent to a required horizontal dimension. Still further, it is desirable to provide such a vent which is readily manufacturable and which can be constructed at an economical cost.

SUMMARY OF THE INVENTION

The present invention overcomes the disadvantages of the prior art by providing a fireplace vent of the direct-vent type comprising two outer air intake housings each having a generally rectangular cross-section and being telescopingly receivable one within the other. Internal to each air intake housing is an exhaust housing spaced from the inside walls of the intake housings and being telescopingly receivable one within the other. The exhaust housings are preferably trapezoidal in cross-section. The cross-sectional areas of the exhaust housings are approximately equal to the difference between the cross-sectional areas of the outer intake housings minus the areas of the exhaust housings. A pair of parallel spaced heat shields are disposed adjacent the upper walls of the intake housings. The vent as thus constructed provides for significant savings in clearance between a fireplace and an associated window or shelving system and is also readily adjustable in length to accommodate varying installation conditions.

BRIEF DESCRIPTION OF THE DRAWINGS

The foregoing and other novel features and advantages of the present invention will be better understood upon a reading of the following detailed description taken in conjunction with the accompanying drawings wherein.

DETAILED DESCRIPTION OF THE PREFERRED EMBODIMENTS

Figure 1:
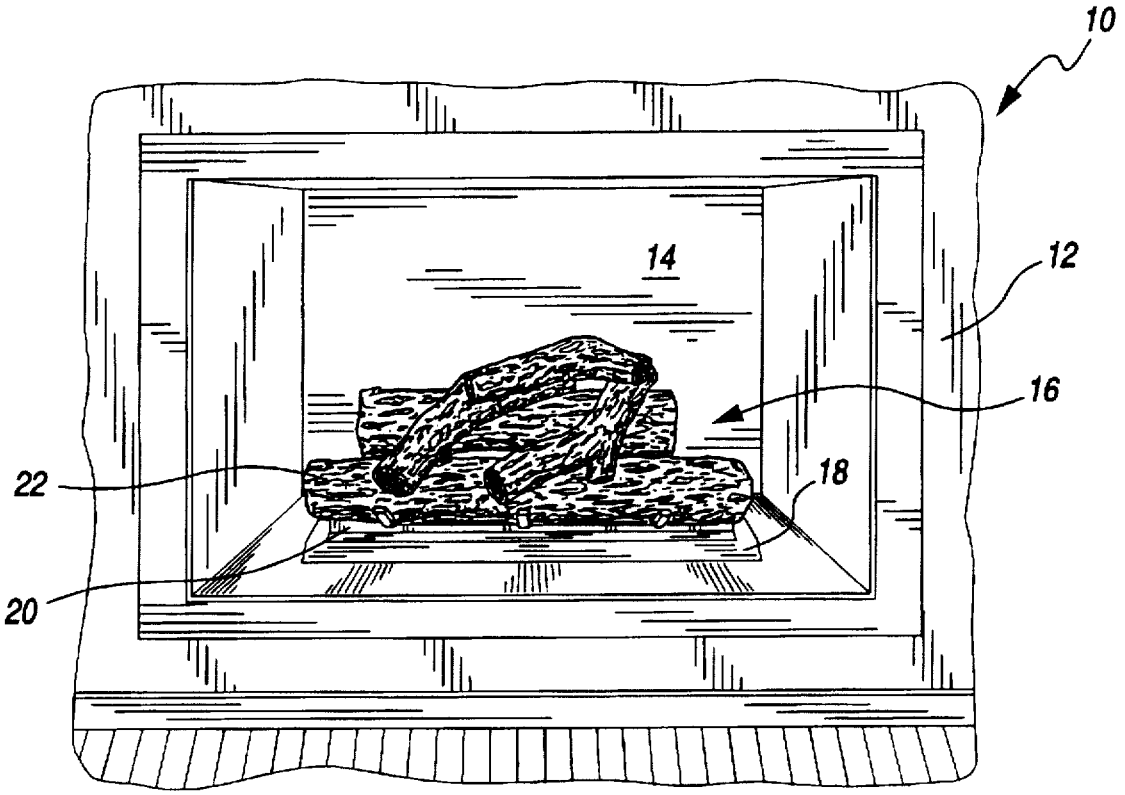
FIG. 1 is a front elevational view of a prior art factory-built fireplace of a type suitable for use with a vent constructed in accordance with the principles of the invention.

Referring now to the drawings, and initially to FIG. 1, a typical prior art fireplace assembly of a factor-built gas-fixed type is designated generally by the reference numeral 10. The illustrated fireplace 10 is designed to be recessed into a wall 12 of a room and includes an enclosure 14 which defines a combustion chamber 16. The assembly 10 may include a pan-type burner 18 over which a suitable grate 20 supports a plurality of artificial ceramic or cement logs 22. The front face of the enclosure 14 may be sealed with a glass panel (not shown).

Figure 2:
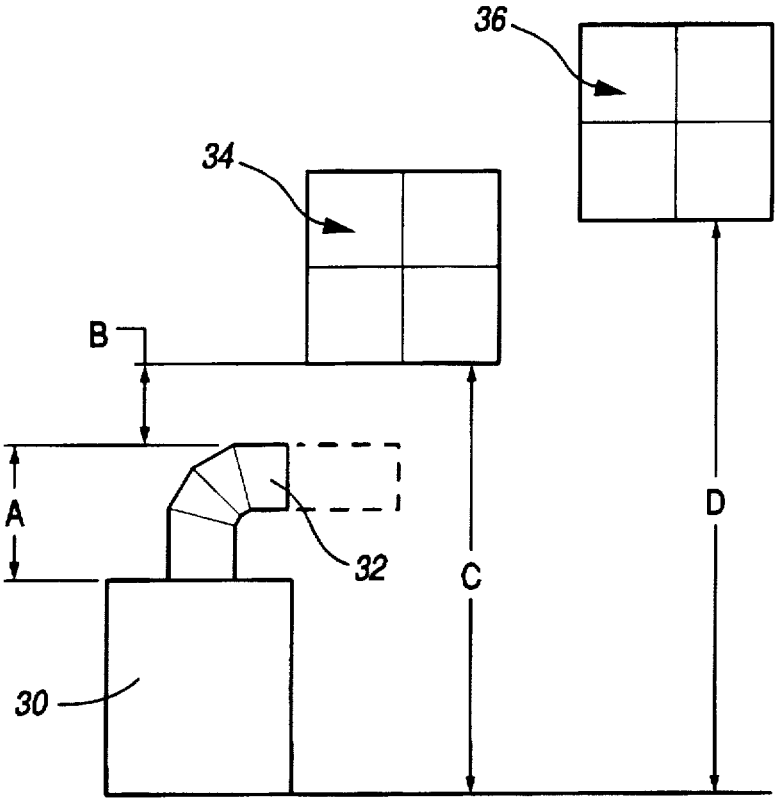
FIG. 2 is a side schematic view of a typical fireplace shown as being vented using a prior art vent system.

Turning now to the schematic view of FIG. 2, a fireplace assembly is designated 30 and may be of a type manufactured under Model No. GC 300 by the assignee herein. This assembly 30 is shown as a wall-vented unit, vented by a typical round concentric direct-vent pipe 32 having an outer diameter of on the order of eight inches. In such an installation, the top of the vent pipe 32 will typically be about fourteen inches or so above the top of the fireplace 30, shown by the dimension A. When installed beneath an operable window 34, the top of the vent pipe 32 must, by standard building codes, be at least three inches from the bottom of the window 34, shown as dimension B. This requires that the window 34 be no less than about fifty-two inches above the floor, shown as dimension C. When the fireplace 30 is installed with standard vent pipe 32 beneath an operable window 36, typical codes will require that the window be no less than fifty-eight inches, shown as dimension D.

Figure 3:
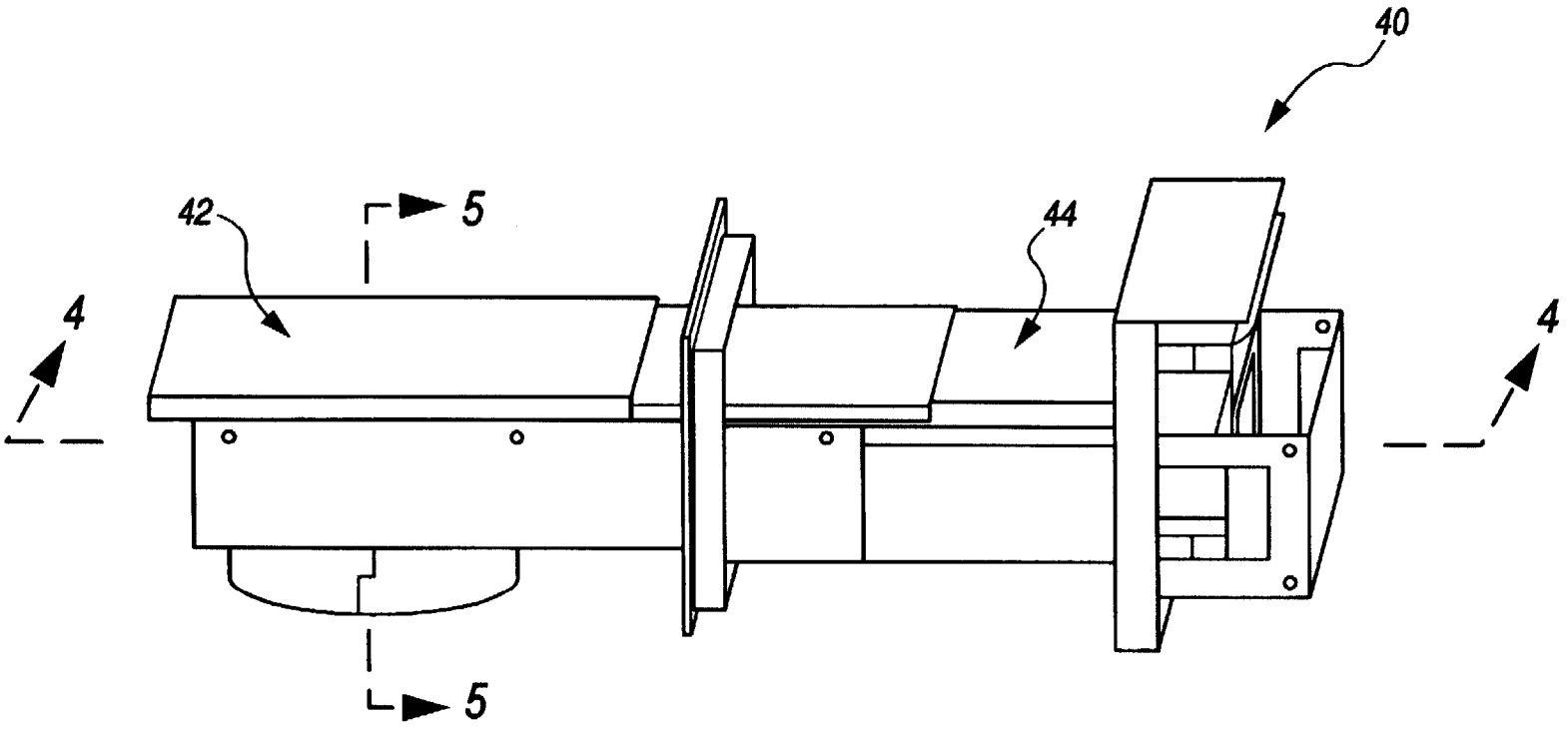
FIG. 3 is a side perspective view of fireplace vent constructed in accordance with the principles of the present invention.
Figure 4:
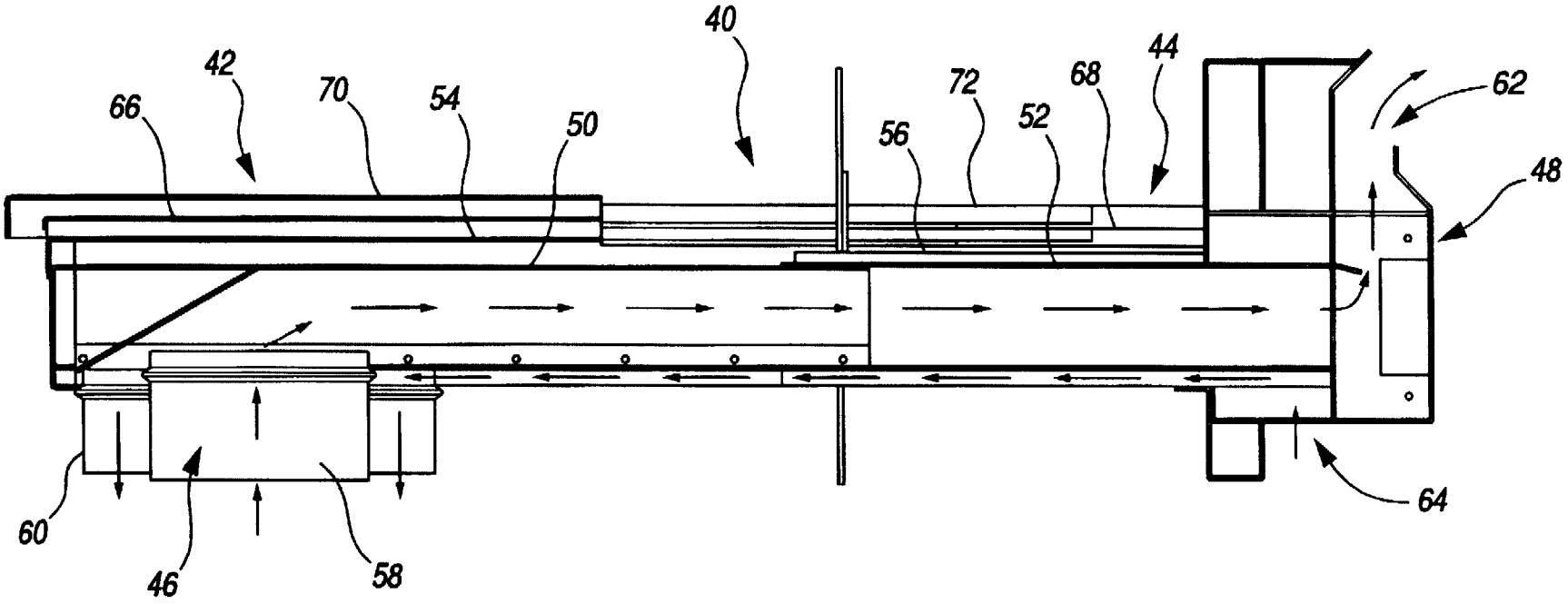
FIG. 4 is a cross-sectional view taken substantially along the line 4—4 of FIG. 3.
Figure 5:
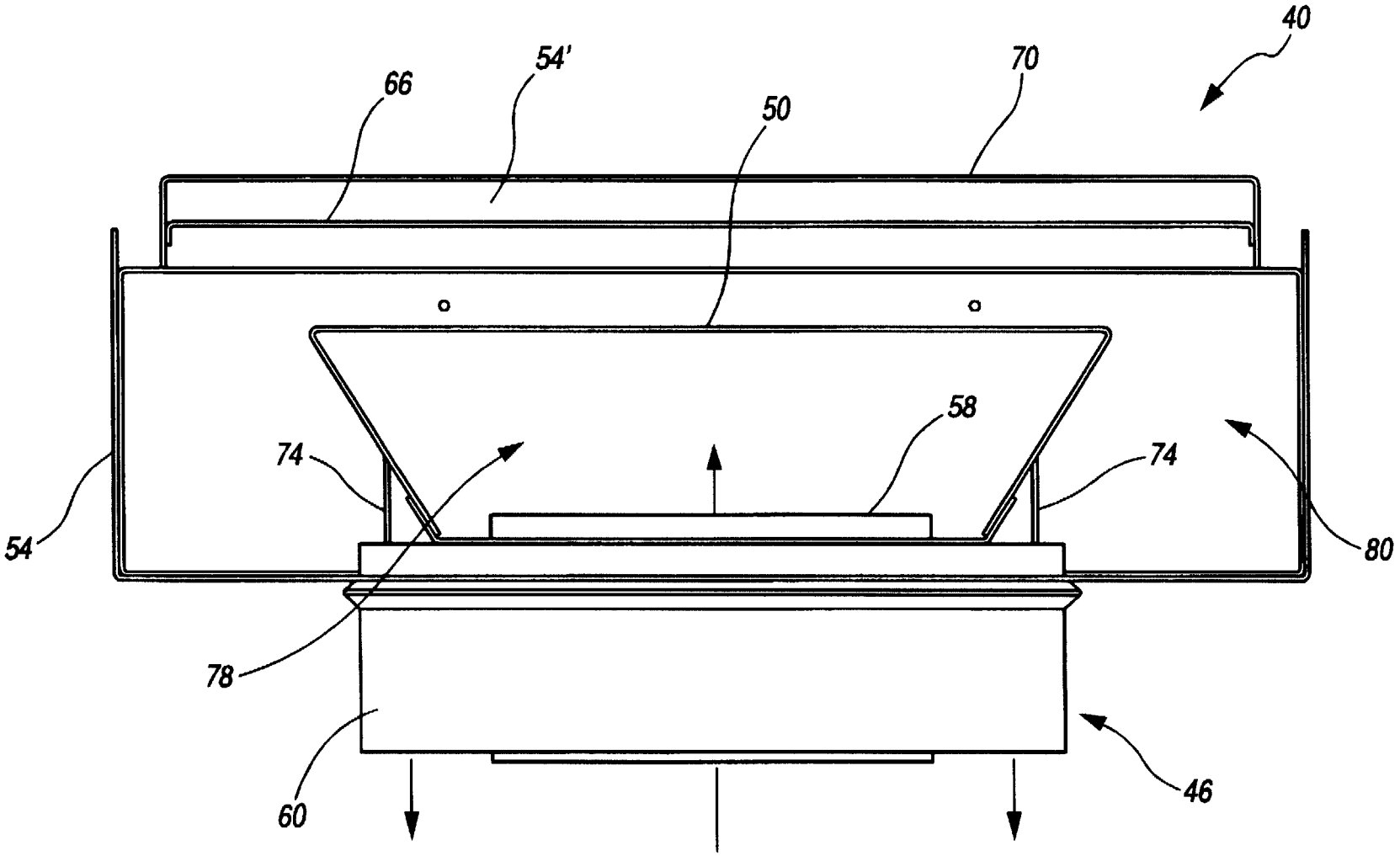
FIG. 5 is a cross-sectional view taken substantially along the line 5—5 of FIG. 3.

Referring now to FIGS. 3–5, a vent assembly constructed in accordance with the principles of the invention is designated generally as 40. The vent 40 comprises as its principal components a first vent section 42 and a second vent section 44. As will be apparent particularly from FIG. 4, these sections 42 and 44 are fabricated from suitable sheet metal and are designed such that section 42 and 44 are telescopingly receivable within each other. Their component pieces may be spot-welded or riveted together in a manner well-known in the art. At one end, the vent 40 is constructed with a downwardly open adapter 46 for mating the vent 40 with a standard round concentric vent pipe of a fireplace. The other end of the vent 40 is fitted with a termination cap assembly 48.

The details of the vent 40 can best be seen in the cross-sectional views of FIGS. 4 and 5. Internal to each section 42 and 44 of the vent 40 are exhaust housings 50 and 52, respectively. Spaced from the exhaust housings 50 and 52 are air intake housings 54 and 56, respectively. At the adapter 46 end of section 42, the exhaust housing 50 is formed to fit around a central exhaust pipe 58 portion of the adapter 46 while the intake housing 54 is formed to fit around the larger outer pipe 60 portion of the adapter 46. At the cap 48 end of section 44, the inner exhaust housing 52 is open to an upwardly direct outlet 62 while the intake housing 56 is open to a downwardly directed air inlet 64. In order to avoid heat build-up on the upper outer surfaces of the vent sections 42 and 44, the sections 42 and 44 are provided with first heat shields 66 and 68, which are spaced from the upper walls 54' and 56' of the housings 54 and 56, respectively, and second heat shields 70 and 72, which are spaced from the first heat shields 66 and 68, respectively. In one preferred form the heat shields are parallel to and substantially coextensive with the upper walls of the housings 54 and 56. The shield 68 is telescopingly receivable within shield 66, and shield 72 is likewise telescopingly receivable within shield 70. In order to support the exhaust housings 50 and 52 within the intake housings 54 and 56, suitable legs 74 may be provided at spaced intervals within the vent 40.

It can now be appreciated that the vent 40 is capable of convenient installation by virtue of the telescoping and slidable configurations of the vent sections 42 and 44. By this construction, the vent 40 can be adjusted, without cutting, to a wide variety of longitudinal dimensions thereby readily accommodating varying conditions in the field such as differing wall thicknesses of the building. An important feature of the invention, as seen in FIG. 5, is that the inner exhaust housings 50 and 52 are preferably formed with trapezoidal cross-sections. By this configuration, the exhaust area 78 can be dimensioned to be approximately equal to the intake area 80, while maintaining the overall size of the vent 40 as a compact assembly.

Figure 6:
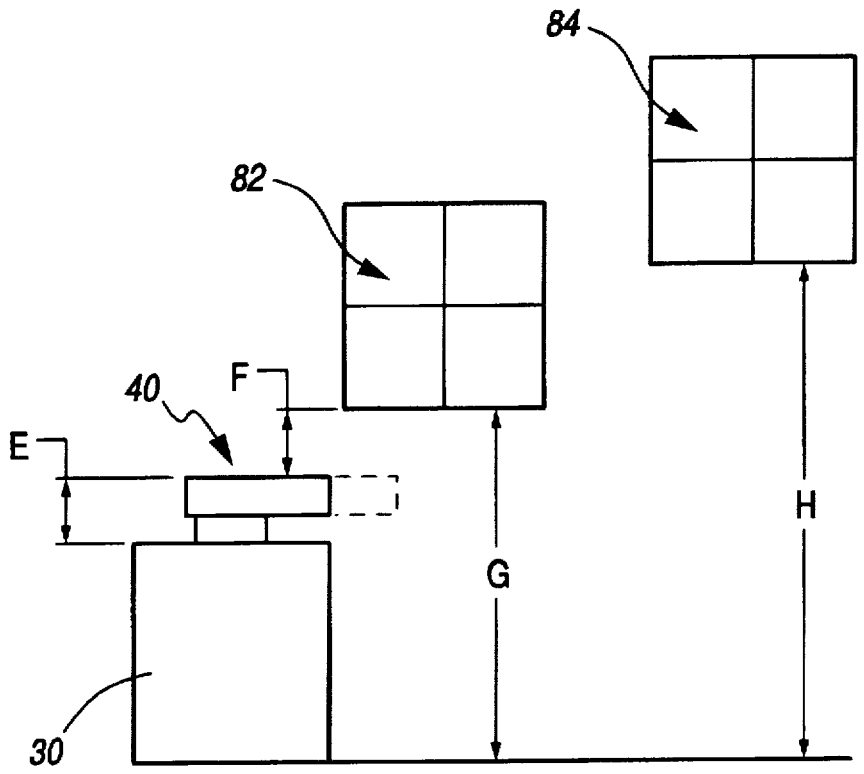
FIG. 6 is a side schematic view of a typical fireplace installed using a vent constructed according to the invention.

The operation of the vent can be seen with reference to the schematic view of FIG. 6. Using the same Model GC 300 fireplace as described with reference to FIG. 2, the total height of the vent 40 above the fireplace in a preferred embodiment can be as little as 6¾ inches, shown as dimension E. Further, because of the effective use of the heat shields the vent 40 need only have two inches of clearance beneath a shelving system or inoperable window 82, shown as dimension F. Thus, the window 82 height in this example can be as low as forty-four inches above the floor, shown as dimension G. Moreover, for an operable window 84 the window 84 height can be as low as fifty-one inches, shown as dimension H.

While the present inventions have been described in connection with preferred embodiments, thereof, it will be apparent to those skilled in the art that many changes and modifications may be made without departing from the true spirit and scope of the invention. Accordingly, it is intended by the appended claims to cover all such changes and modifications as come within the true spirit and scope of the invention.

What is claimed is:

1. A vent for a fireplace of the type having a central upwardly directed exhaust pipe disposed within a concentric upwardly directed intake pipe, the vent comprising:

a generally elongate first air intake housing;

a generally elongate first exhaust housing fixed within and in spaced relation to said first air intake housing;

a generally elongate second air intake housing; and a generally elongate second exhaust housing fixed within and in spaced relation to said second air intake housing;

said first and second air intake housings and associated exhaust housings being telescopingly receivable within one another so as to cause said vent to be selectively adjustable in longitudinal length;

said first intake housing having an end configured to be received in communication with an intake air conduit of a direct vent fireplace and with said associated air exhaust housing simultaneously in communication with an exhaust conduit of said fireplace;

second intake housing having an end configured with a first opening for receiving intake air and with a second opening in communication with said associated exhaust housing, said first and second openings being directed opposite one another on said end of said second intake housing.

2. The vent of claim 1 wherein said first and second air intake housings are generally rectangular in cross-section.

3. The vent of claim 1 wherein said first and second exhaust housing are generally trapezoidal in cross-section.

4. The vent of claim 1 wherein the cross-sectional area of each exhaust housing is approximately equal to the difference between the cross-sectional area of the intake housings minus the cross-sectional area of the exhaust housings.

5. The vent of claim 1 including a pair of first heat shields each comprising a flat, planar member substantially coextensive with and mounted in parallel spaced relation to an upper wall of each outer intake housing when said vent is disposed in a horizontal disposition.

6. The vent of claim 5 including a pair of second heat shields each comprising a flat planar member substantially coextensive with and mounted in parallel spaced relation to each first heat shield.

7. A vent for a fireplace of the type having a central upwardly directed exhaust pipe disposed within a concentric upwardly directed intake pipe, the vent comprising:

a generally elongate first air intake housing;

a generally elongate first exhaust housing fixed within and in spaced relation to said first air intake housing;

a generally elongate second air intake housing;

a generally elongate second exhaust housing fixed within and in spaced relation to said second air intake housing;

said first and second air intake housings and associated exhaust housings being telescopingly receivable within one another so as to cause said vent to be selectively adjustable in longitudinal length;

said first intake housing having an end configured to be received in communication with an intake air conduit of a direct vent fireplace and with said associated air exhaust housing simultaneously in communication with an exhaust conduit of said fireplace;

said second intake housing having an end configured with a first opening for receiving intake air and with a second opening in communication with said associated exhaust housing; and said first and second exhaust housings being generally trapezoidal in cross-section.

8. The vent of claim 7 wherein said first and second air intake housings are generally rectangular in cross-section.

9. The vent of claim 7 wherein the cross-sectional area of each exhaust housing is approximately equal to the difference between the cross-sectional area of the intake housings minus the cross-sectional area of the exhaust housings.

10. The vent of claim 7 including a pair of first heat shields each comprising a flat, planar member substantially coextensive with and mounted in parallel spaced relation to an upper wall of each outer intake housing when said vent is disposed in a horizontal disposition.

11. The vent of claim 10 including a pair of second heat shields each comprising a flat planar member substantially coextensive with and mounted in parallel spaced relation to each first heat shield.

12. A vent for a fireplace of the type having a central upwardly directed exhaust pipe disposed within a concentric upwardly directed intake pipe, the vent comprising:

a generally elongate first air intake housing;

a generally elongate first exhaust housing fixed within and in spaced relation to said first air intake housing;

a generally elongate second exhaust housing fixed within and in spaced relation to said second air intake housing;

said first and second air intake housings and associated exhaust housings being telescopingly receivable within one another so as to cause said vent to be selectively adjustable in longitudinal length;

said first intake housing having an end configured to be received in communication with an intake air conduit of a direct vent fireplace and with said associated air exhaust housing simultaneously in communication with an exhaust conduit of said fireplace;

said second intake housing having an end configured with a first opening for receiving intake air and with a second opening in communication with said associated exhaust housing, said first and second openings being directed opposite one another on said end of said second intake housing; and a pair of first heat shields each comprising a flat, planar member substantially coextensive with and mounted in parallel spaced relation to an upper wall of each outer intake housing when said vent is disposed in a horizontal disposition.

13. The vent of claim 12 wherein said first and second air intake housings are generally rectangular in cross-section.

14. The vent of claim 12 where in said first and second exhaust housings are generally trapezoidal in cross-section.

15. The vent of claim 12 wherein the cross-sectional area of each exhaust housing is approximately equal to the difference between the cross-sectional area of the intake housings minus the cross-sectional area of the exhaust housings.

16. The vent of claim 12 including a pair of second heat shields each comprising a flat, planar member substantially coextensive with and mounted in parallel spaced relation to each first heat shield.

* * * * *